US006269891B1

(12) United States Patent
Runia

(10) Patent No.: US 6,269,891 B1
(45) Date of Patent: Aug. 7, 2001

(54) THROUGH-DRILL STRING CONVEYED LOGGING SYSTEM

(75) Inventor: Douwe Johannes Runia, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/392,520

(22) Filed: Sep. 9, 1999

(30) Foreign Application Priority Data

Sep. 21, 1998 (EP) ..... 98117831

(51) Int. Cl.[7] ..... G01V 3/00; E21B 47/00; E21B 10/04

(52) U.S. Cl. ..... 175/40; 175/393

(58) Field of Search ..... 175/40, 49, 50, 175/337–340, 393, 417, 418, 424; 340/854.9, 855.1, 855.2

(56) References Cited

U.S. PATENT DOCUMENTS 2,179,010 11/1939 Creighton .
2,284,580 5/1942 Kammerer .
3,052,838 9/1962 Bennett .
3,112,442 11/1963 Bennett .
3,429,387 2/1969 Brown .
3,700,049 10/1972 Tiraspolsky et al. .
5,244,050 9/1993 Estes .
5,589,825 12/1996 Pomerleau .

*Primary Examiner*—Robert E. Pezzuto

(57) ABSTRACT

A system for drilling and logging of a wellbore formed in an earth formation is provided. The system comprises a logging tool string and a drill string having a longitudinal channel for circulation of drilling fluid, the drill string including a port providing fluid communication between the channel and the exterior of the drill string, the channel and the port being arranged to allow the logging tool string to pass through the channel and from the channel through the port to a position exterior of the drill string. The system further comprises a removable closure element adapted to selectively close the port, wherein the logging tool string may be selectively connected to the closure element.

10 Claims, 3 Drawing Sheets

THROUGH-DRILL STRING CONVEYED LOGGING SYSTEM

FIELD OF THE INVENTION

The present invention relates to a system for drilling and logging of a wellbore formed in an earth formation. The invention furthermore relates to a drill string for use in conjunction with the system, to a logging tool string for use in conjunction with the system, and to a method of drilling and logging of a wellbore formed in an earth formation using the system.

BACKGROUND OF THE INVENTION

U.S. Pat. No. 5,589,825 discloses a system whereby a logging tool string is lowered through the longitudinal fluid channel of the drill string until the logging tool is located opposite a number of windows provide in the wall of the drill string. Logging signals pass from the logging tool through the windows into the earth formation. Only limited logging information can be obtained with this known system, due to the limited size of the windows. Furthermore, this system requires precise positioning of the logging tool relative to the windows.

U.S. Pat. No. 3,112,442 discloses a system whereby a logging tool passes through the fluid channel of a drill string until a number of electrodes of the tool pass through the fluid nozzles to below the drill bit. The electrodes are of limited size and have limited capacity for emitting and receiving logging signals. Another drawback of this system is that passage of the electrodes through the nozzles can be hampered by the shape and direction of the nozzles.

It is an object of the invention to provide a system for drilling and logging of a wellbore formed in an earth formation, which overcomes the drawbacks of the known systems, and which is robust and provides adequate logging information without hampering drilling operations.

It is another object of the invention to provide a drill string for use in conjunction with the system of the invention.

It is a further object of the invention to provide a logging tool string for use in conjunction with the system of the invention.

It is yet another object of the invention to provide a method of drilling and logging of a wellbore formed in an earth formation using the system of the invention.

SUMMARY OF THE INVENTION

In accordance with the invention there is provided a system for drilling and logging of a wellbore formed in an earth formation, the system comprising a logging tool string and a drill string having a longitudinal channel for circulation of drilling fluid, the drill string including a port providing fluid communication between the channel and the exterior of the drill string, the channel and the port being arranged to allow the logging tool string to pass through the channel and from the channel through the port to a position exterior of the drill string, the system further comprising a removable closure element adapted to selectively close the port, wherein the logging tool string is provided with connecting means for selectively connecting the logging tool string to the closure element.

DETAILED DESCRIPTION

Figure 1:
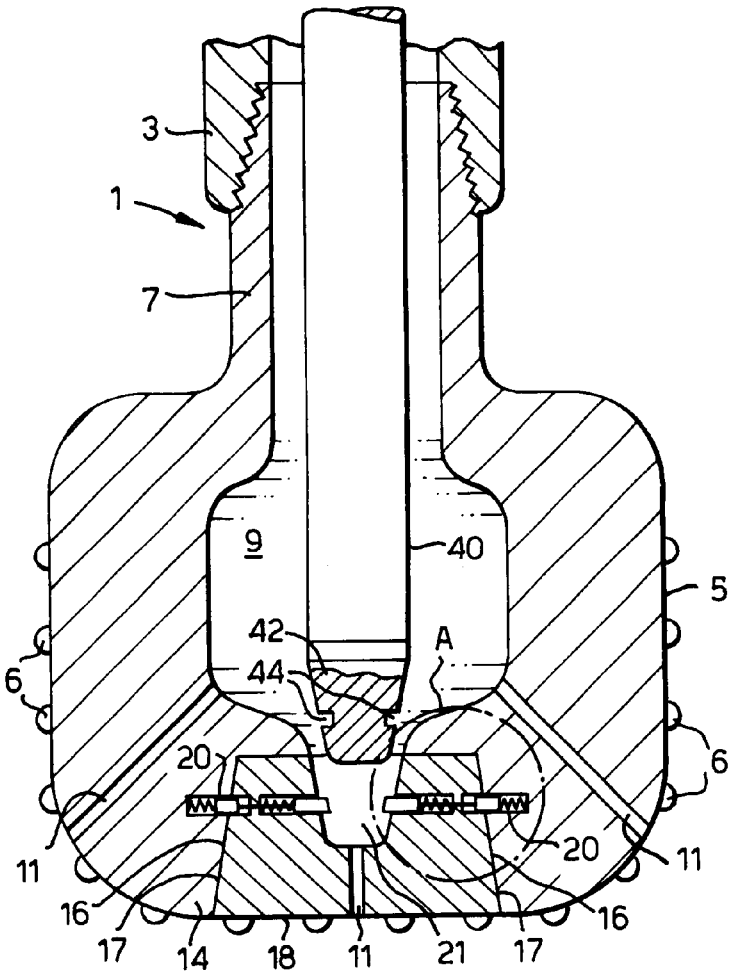
FIG. 1 schematically shows a longitudinal section of a first embodiment of the system according to the invention.

By lowering the logging tool string through the channel and connecting the logging tool string to the closure element using the connecting means, the closure element can be removed from the drill string by further lowering of the logging tool string while the closure element remains attached to the logging tool string. When the logging tool string extends in the space exterior of the drill string a logging operation can be performed. The closure element can be re-used for drilling of a further wellbore section after finalising the logging operation. Furthermore the closure element does not form an obstacle in the wellbore after being removed from the drill string.

Preferably the drill string includes a drill bit arranged at the lower end of the drill string, and wherein the port is provided in the drill bit. In this manner it is achieved that the closure element can be made as an integral, yet removable, part of the drill bit and does not negatively affect the drilling properties of the drill bit.

Suitably said connecting means forms secondary connecting means, and the closure element is provided with primary connecting means for selectively connecting the closure element to the drill string.

Preferably the primary connecting means includes a primary latching device for latching the closure element to the drill string.

In an advantageous embodiment said connecting means includes a secondary latching device for latching the logging tool string to the closure element.

It is preferred that the primary and secondary latching devices are arranged so as to unlatch the closure element from the drill string upon latching of the logging tool string to the closure element.

To prevent the closure element from rotating relative to the port element during drilling, the closure element and the port have co-operating contact surfaces of non-circular shape in a plane perpendicular to the longitudinal axis of the drill string.

The method according to the invention comprises:

- drilling a section of said wellbore by operation of the drill string whereby the closure element closes the port;
- lowering the logging tool string through said channel to the closure element;
- connecting the logging tool string to the closure element;
- further lowering the logging tool string with the closure element connected thereto through the port to a position exterior of the drill string;
- operating the logging tool string so as to provide logging data of the earth formation.

Lowering of the logging tool string through the channel can be done for example by pumping down the logging tool string by lowering on a wireline.

The logging tool string is preferably operated in a self-contained manner (i.e. by power- and memory control of the tool string) with automatic pre-set start up.

The invention will be further described in more detail and by way of example with reference to the Figures. In the Figures, like reference numerals relate to like components.

Referring to FIG. 1 there is shown a drill string 1 for drilling a wellbore into an earth formation, the drill string 1 having a drill collar 3 to which a drill bit 5 provided with cutting elements 6 is connected. The drill string 1 has a longitudinal channel 7 for circulation of drilling fluid, which channel 7 debouches into a fluid chamber 9 of the drill bit 5. Nozzles 11 are provided in the drill bit 5 for injection of drilling fluid from the chamber 9 into the wellbore. The drill bit 5 has a bottom wall 14 provided with a central opening in the form of port 16 which is covered by a closure element in the form of insert section 18. The port 16 and the insert section 18 have a contact surface 17 of frustoconical shape so as to allow removal of the insert section 18 from the port 16 in outward direction. The insert section 18 and the drill bit 5 are provided with a latching mechanism 20 for latching of the insert section 18 to the drill bit 5 and for latching of a logging tool string (referred to hereinafter) to the insert section 18. The insert section 18 is at its side facing the fluid chamber 9 provided with a recess 21 for receiving the logging tool string.

Figure 2:
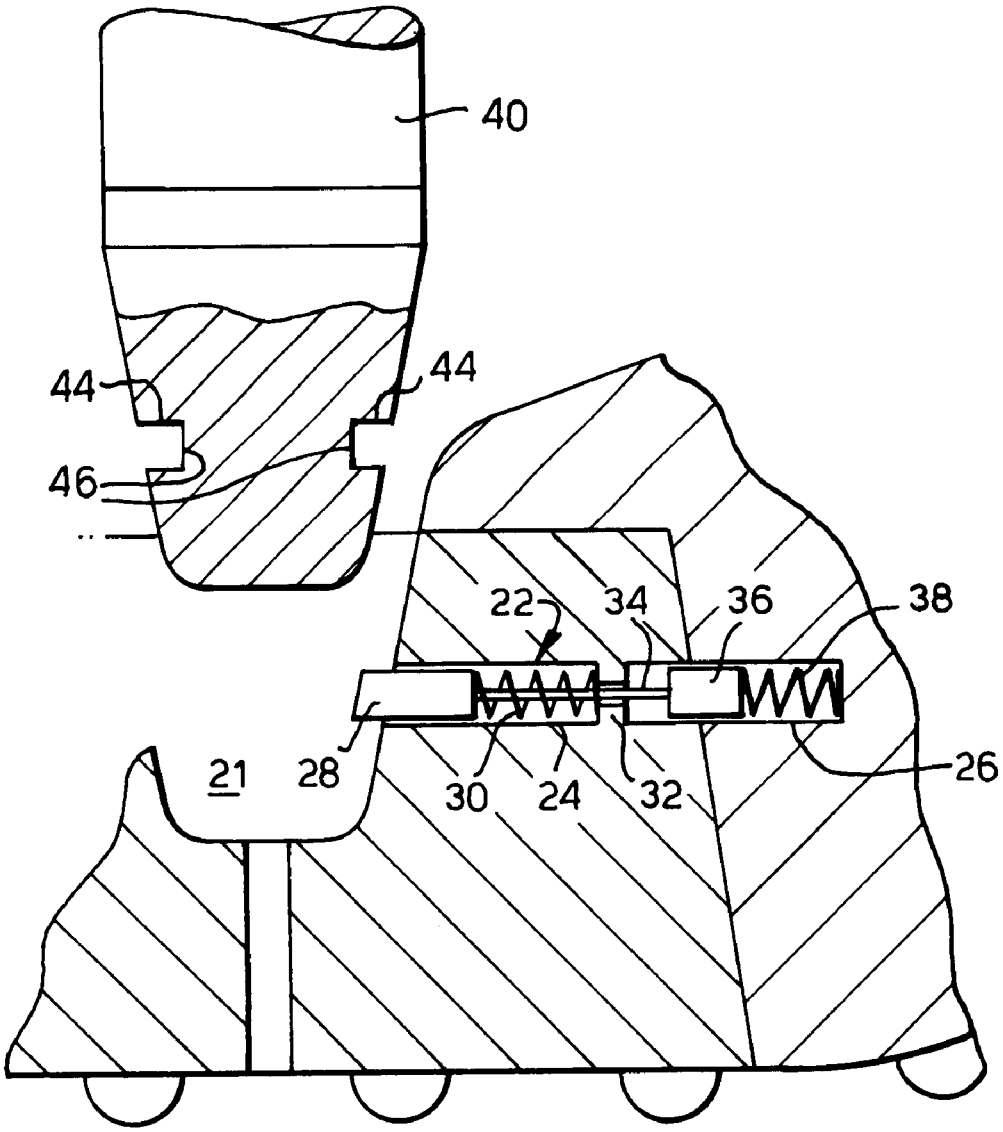
FIG. 2 schematically shows a detail of FIG. 1.

In FIG. 2 is shown detail A of FIG. 1. The latching mechanism 20 includes a number of locking devices 22 spaced at regular angular intervals along the contact surface 17. Each locking device 22 includes a radial bore 24 formed in the insert section 18 and a corresponding radial bore 26 formed in the drill bit 5, the bores 24, 26 being aligned when the port 16 is covered by the insert section 18. A first locking member 28 extends from bore 24 a short distance into chamber 9. The first locking member is 28 biased in this position by one end of a first helical spring 30 which is biased at its other end against an annular shoulder 32 provided in bore 24. The first locking member 28 is connected to one end of a rod 34 which extends through the annular shoulder 32 and rests at its other end against a second locking member 36. The second locking member 36 extends from bore 24 into bore 26 and is biased in this position by a second helical spring 38 arranged in the bore 26 at the side of the second locking member 36 opposite the rod 34.

A logging tool string 40 extends through channel 7 into chamber 9, the logging tool string being provided with a set of logging tools (not shown), a power unit (not shown) and an electronic memory unit (not shown). The outside diameter of the logging tool string 40 is selected so as to allow passage thereof through the port 16. The logging tool string 40 has a lower end part in the form of tool nose 42 which fits into the recess 21 of the insert section 21, the tool nose 42 and the recess 21 having a contact surface of frustoconical shape allowing easy access of the tool nose 42 into the recess 21. The tool nose 42 is provided with a circumferential groove 44 which is aligned with the radial bores 24 when the tool nose 42 is received into the recess 21. The depth of the groove 44 is selected so that when the groove 44 and the bores 24 are aligned, the first locking member 28 is biased by spring 30 against the end wall 46 of groove 44, and the second locking member 36 extends fully into the bore 26.

Figure 3:
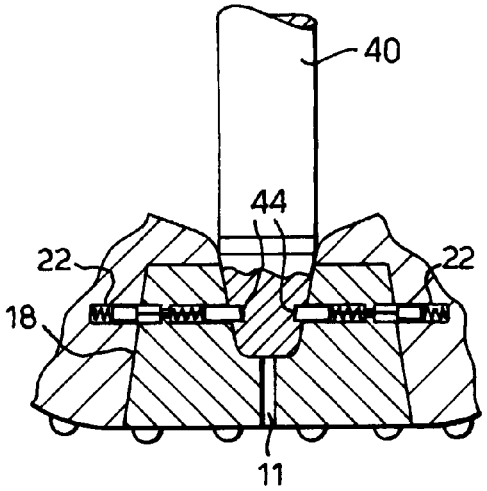
FIG. 3 schematically shows a longitudinal section of the closure element and the logging tool string of FIG. 1.

During normal operation of the system shown in the FIGS. 1–3, the drill string 1 is operated to drill a new wellbore interval (not shown). During drilling the insert section 18 covers the port 16 and is held in this position by locking devices 22 whereby each locking member 36 extends from bore 24 into corresponding bore 26. After drilling is stopped the drill string 1 is lifted a selected distance to allow the logging tool string 40 to be positioned below the drill bit 5. Then the logging tool string is lowered through the channel 7 and from there via chamber 9 into recess 21. Upon the tool nose 42 being received in recess 21 each first locking member 28 latches into the groove 44. As indicated above, latching of the first locking member 28 into groove 44 causes the second locking member 36 to become fully located in bore 26. Thereby the insert section 18 becomes unlatched from the drill bit 5. The logging tool string 40 with the insert section 18 latched to the tool nose 42 is subsequently lowered through port 16 to the space in the wellbore below the drill bit 5. In this position the logging tool string 40 is suspended by suspension means, for example by an annular shoulder (not shown) provided on the tool string 40 which rests on a corresponding annular shoulder (not shown) provided in the chamber 9 of the drill bit. Alternatively the logging tool string can be suspended on wireline from surface, or by any other suitable means.

With the logging tool string 40 in the suspended position, the drill string is lifted through the wellbore so as to move the logging tool string through the newly drilled interval, and simultaneously each logging tool of the tool string 40 is operated to provide a set of logging data of the earth formation surrounding the newly drill interval. The logging data are stored in the electronic memory unit.

The logging procedure described above can be carried out in the course of a tripping run of the drill string 1 whereby the drill string is retrieved to surface, for example to fit a new drill bit to the drill string. Alternatively, after logging is completed, the logging tool string 40 is lifted back into the drill string 1 until the insert section 18 covers port 16. Upon entry of insert section 18 into port 16 each second locking member 36 latches into the corresponding bore 24 of the insert section 18 by the action of the second spring 38 and thereby locks the insert section 18 to the port 16. With the port 16 covered by the insert section 18, a further wellbore interval can be drilled and procedure described above can be repeated.

Figure 4:
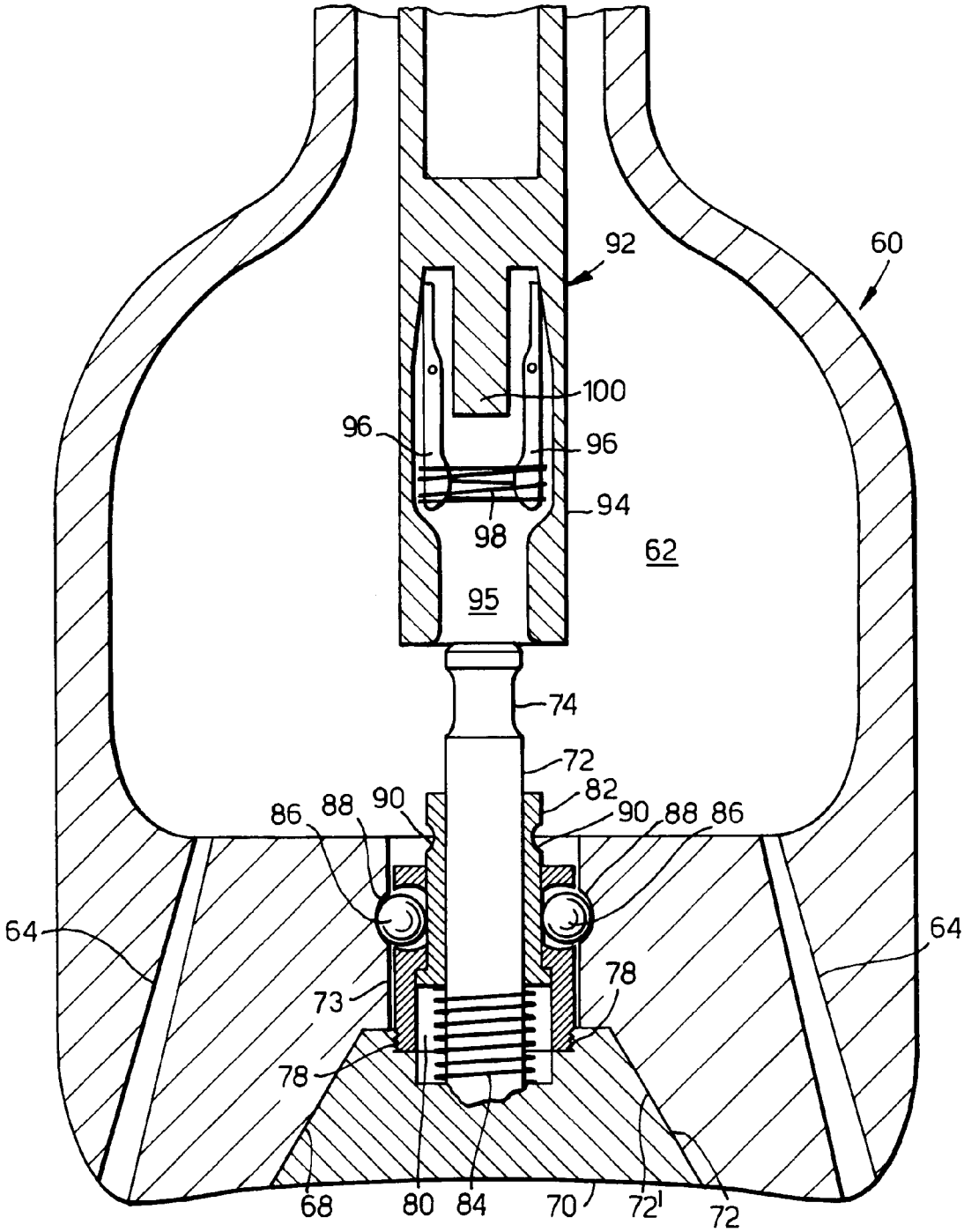
FIG. 4 schematically shows a longitudinal section of a second embodiment of the system according to the invention.

In FIG. 4 is shown a second embodiment of the system of the invention. In the second embodiment a drill bit 60 is arranged at the lower end of a drill string (not shown) having a longitudinal channel (not shown) for circulation of drilling fluid, which channel debouches into a fluid chamber 62 of the drill bit. The drill bit is provided with a plurality of nozzles 64 for injection of drilling fluid from the chamber 62 into the wellbore to be drilled. The drill bit 60 has a bottom wall 66 provided with a central opening in the form of port 68 having an oval shape when seen in a plane perpendicular to the longitudinal axis of the drill string. The port 68 is aligned with the longitudinal channel of the drill string and is covered by a closure element in the form of insert section 70. The outer surface of insert section 70 is fully conformed to the bottom surface of the drill bit 60 so that the drilling characteristics of the drill bit 60 with the insert section 70 inserted in the port 68, are equivalent to those of a conventional drill bit. The port 68 and the insert section 70 have respective contact surfaces 72, 72' of frustoconical shape so as to allow removal of the insert section 70 from the port 68 in outward direction. The drill bit 60 is furthermore provided with a cylindrical channel 73 providing fluid communication between the port 68 and the chamber 62, the channel 73 being aligned with the longitudinal channel of the drill string.

The insert section 70 is connected to the drill bit 60 by a primary latching device including a post 72 integrally formed with the insert section and extending into the chamber 62. The post 72 is near its upper end provided with an annular 5 recess 74. A cylindrical cage 76 is connected to the insert section 70 by threaded connection 78 extends concentrically around the post 72 with an annular space 80 between the cage 76 and the post 72. A cylindrical sleeve 82 extends in the annular space 80, the sleeve being slideable along the post 72 and being biased in the direction of the chamber 62 by a spring 84. The cage 76 retains four metal locking balls 86 which extend into four locking recesses 88 provided in the wall of the channel 73. The sleeve 82 is provided with four releasing recesses 90 into which the locking balls fit when the sleeve 82 is biased a sufficient distance against the force of the spring 84. For the purpose of clarity only two locking balls 86, two locking recesses 88 and two releasing recesses 90 are shown.

A logging tool string 92 extends through the longitudinal channel of the drill string into chamber 62, the logging tool string being provided with a set of logging tools (not shown), a power unit (not shown) and an electronic memory unit (not shown). The outside diameter of the logging tool string 92 allows passage of the string 92 through the port channel 73 and the port 68. The logging tool string 92 is connectable to the insert section 70 by a secondary latching device which includes a lower part 94 of the logging tool string 92, said lower part 94 having a lower end 94a and an interior space 95 of diameter corresponding to the overall diameter of the post 72 so that the post 72 fits into the interior space 95. The lower part 94 is internally provided with four locking dogs 96 (only two of which are shown) pivotally connected to the lower part 94 and biased in radially inward direction by spring 98. The interior space 95 is furthermore provided with a landing surface 100 arranged at a longitudinal distance from the locking dogs 96 selected such that when the landing surface 100 contacts the distal end of the post 72 the locking dogs 96 are received in the annular recess 74 of the post. Furthermore, the longitudinal distance between the landing surface 100 and the lower end of the logging tool string 92 is selected such that when the landing surface 100 contacts the distal end of the post 72, the lower end 94a biases the sleeve 82 to the position whereby the releasing recesses 90 are opposite the respective locking balls 86.

During normal operation the drill string is operated to drill a new wellbore interval (not shown). During drilling the sleeve 82 is biased by spring 84 to the position shown in FIG. 4 so that the locking balls 86 are forced by the sleeve 82 into the respective locking recesses 88 of the bit body, thereby latching the insert section 70 to the drill bit 60.

After drilling of the wellbore interval is completed the drill string is lifted a selected distance from the bottom of the wellbore and the logging tool string 92 is lowered through the drill string into the chamber 62. The logging tool string 92 is further lowered whereby the post 72 enters the space 95 and contacts the landing surface 100, whereby the lower end of the logging tool string 92 pushes the sleeve 82 against the force of the spring 84 until the releasing recesses 90 become located opposite the respective locking balls 86. In this position the sleeve 82 no longer forces the locking balls 86 into the locking recesses 88 so that the insert section 70 becomes unlatched from the bit body. Simultaneously the locking dogs 96 become engaged in the annular recess 74 of the post 72 and thereby latch the logging tool string 92 to the insert section 70. The logging tool string 92 with the insert section latched thereto is then further lowered via the channel 73 and the port 68 until the logging tools of the string 92 become located below the drill bit 60, in which position the logging tool string 92 is suspended and the logging tools are operated.

After logging is completed, the logging toll string 92 is lifted until the insert section 70 contacts the port 68. The logging tool string is then further lifted thereby unlatching the locking dogs 96 from the annular recess 74 and allowing the sleeve 82 to slide along the post 72 in the direction of the chamber 62 by the action of the spring 84. The sleeve 82 thereby forces the locking balls 86 into the respective locking recesses 88 so that the insert section 70 becomes latched to the drill bit 60 and covers the port 68.

A further wellbore interval can then be drilled and logged in the manner described above, or the drill string can be retrieved to surface is necessary.

The logging tool string can be lowered through the drill string by pump-down operation, by wireline or by a combination of wireline and pump-down operation. Lifting of the logging tool string can be done by wireline, by reverse pumping (i.e. pumping fluid from the annular space between the drill string and the wellbore wall/casing into the drill string), or by a combination thereof.

The logging data stored in the electronic memory unit can be retrieved to surface by retrieving the logging tool through the drill string to surface, by retrieving the drill string with the logging tool string contained therein to surface, or by transferring the data from the memory unit to surface using suitable signal transfer means.

What is claimed is:

1. A system for drilling and logging of a wellbore formed in an earth formation, the system comprising a logging tool string and a drill string having an exterior and an interior longitudinal channel for circulation of drilling fluid, the drill string including a port providing fluid communication between the channel and the exterior of the drill string, the channel and the port being arranged to allow the logging tool string to pass through the channel and from the channel through the port to a position exterior of the drill string, the system further comprising a removable closure element adapted to selectively close the port, wherein the logging tool string is provided with connecting means for selectively connecting the logging tool string to the closure element.

2. The system of claim 1, wherein said connecting means forms secondary connecting means, and the closure element is provided with primary connecting means for selectively connecting the closure element to the drill string.

3. The system of claim 2, wherein the primary connecting means includes a primary latching device for latching the closure element to the drill string.

4. The system of any one of claims 1–3, wherein said connecting means includes a secondary latching device for latching the logging tool string to the closure element.

5. The system of claim 1, wherein said connecting means forms secondary connecting means, and the closure element is provided with primary connecting means for selectively connecting the closure element to the drill string; wherein the primary connecting means includes a primary latching device for latching the closure element to the drill string; wherein said connecting means includes a secondary latching device for latching the logging tool string to the closure element; and wherein the primary and secondary latching devices are arranged so as to unlatch the closure element from the drill string upon latching of the logging tool string to the closure element.

6. The system of claim 1, wherein the drill string includes a drill bit arranged at the lower end of the drill string, and wherein the port is provided in the drill bit.

7. The system of claim 6, wherein the port is formed by a central opening in the bottom wall of the drill bit, which central opening provides fluid communication between the channel and a space in the wellbore below the drill bit.

8. The system of claim 1, wherein the closure element is removable from the port in outside direction of the drill string.

9. The system of claim 1, wherein the closure element and the port have co-operating contact surfaces of non-circular shape in a plane perpendicular to the longitudinal axis of the drill string.

10. A method of drilling and logging of a wellbore formed in an earth formation using the system of claim 1, the method comprising:

drilling a section of said wellbore by operation of the drill string whereby the closure element closes the port;

lowering the logging tool string through said channel to the closure element;

connecting the logging tool string to the closure element;

further lowering the logging tool string with the closure element connected thereto through the port to a position exterior of the drill string;

operating the logging tool string so as to provide logging data of the earth formation.

* * * * *